US005244120A

United States Patent [19]

O'Meara

[11] Patent Number: 5,244,120

[45] Date of Patent: Sep. 14, 1993

[54] DUAL CHAMBER MEDICAMENT DISPENSER

[75] Inventor: John R. O'Meara, Rossmoor, N.J.

[73] Assignee: CP Packaging, Inc., Jamesburg, N.J.

[21] Appl. No.: 931,989

[22] Filed: Aug. 19, 1992

[51] Int. Cl.[5] ..... B65D 35/22

[52] U.S. Cl. ..... 222/94

[58] Field of Search ..... 222/94, 107, 129, 145

[56] References Cited

U.S. PATENT DOCUMENTS

| | | | |
|---|---|---|---|
| 1,894,115 | 1/1933 | Murphy | 222/94 |
| 3,581,940 | 6/1971 | Cella | 222/94 |
| 4,884,703 | 12/1989 | O'Meara | 222/94 X |
| 4,964,539 | 10/1990 | Mueller | 222/94 |
| 5,076,464 | 12/1991 | Simon | 222/94 X |

FOREIGN PATENT DOCUMENTS

| | | | |
|---|---|---|---|
| 1448291 | 9/1976 | United Kingdom | 222/94 |

*Primary Examiner*—Kevin P. Shaver

*Attorney, Agent, or Firm*—Eugene E. Renz, Jr.

[57] ABSTRACT

A dual compartment container assembly which comprises a container having two adjacent compartments defined by a common wall and a pair of outer arcuate walls. The container has a filling end which is sealed after contents are placed in the compartments and, of course, has a discharge end at the other axial end of the container. The common wall is pleated to have a "s" shaped curved first width prior to filling and an straightened longer width forming a straight line seal at a point spaced from the filling end. The outer walls and the common wall terminate axially at the filling end to provide a filling end seal region. Pressure forms the seal at the filling end by joining the ends of the outer walls and the seal includes the end of the common wall in the seal. The outer walls are joined with the common wall to form axially aligned pivotal junctions to define bellows by causing the compartments to taper outwardly from a point axially inward from the straight line seal. The bellows form no part of the straight line end seal It is preferred that the straight line seal is a heat seal.

9 Claims, 2 Drawing Sheets

DUAL CHAMBER MEDICAMENT DISPENSER

FIELD OF THE INVENTION

The present invention relates to double compartment closure assemblies in which materials are stored in at least two separate compartments until the compartments are opened for use. More particularly, the invention relates to a construction of the closed or filling end of such a dual chamber device in a manner which facilitates the discharge of materials therefrom at a later time when access to the contents of the chambers is desired without any potential compromise to the end seal integrity.

BACKGROUND OF THE INVENTION

The field of cap and tube assemblies which carry medicines, vitamins and the like, have become of major importance and interest in the pharmaceutical industry. There are many such devices, and recently interest has focused on those applications in which two ingredients are kept separate from one another in a single container, such as in a dual chamber dispensing package. At the appropriate time, the multiple components can be used for the intended purpose. Prepackaging of specific doses or quantities is important to save time during the application of medicine or chemicals which need to be mixed promptly or in precise quantities.

Often times, potent drugs which rapidly deteriorate when mixed together are easily and safely maintained in dual chambers to avoid premixing. Since these drugs are often used by geriatric patients who may be limited in their ability to mix in accurate proportions, it is particularly advantageous for them to have the drugs kept apart and mixed accurately just before use.

Multiple container closures are not new per se. In my prior patent, U.S. Pat. No. 4,884,703, a double compartment closure and tube assembly is disclosed which has certain features which have been found to be quite acceptable in a number of markets. Specifically, my patent discloses a container with two adjacent compartments having a common surface at one end with a thin wall portion at that end for each surface. The cap slideably fits on the end of the container and includes puncture means or piercers which are in alignment with the walls so that the movement of the cap will cause the piercers to puncture the thin wall portion of each compartment. The cap is placed in a first position on the end of the container by cooperation between an interference surface ad a surface of resistance. Typically, those surfaces are formed by a ring and groove arrangement.

Another dual compartment container is described in my co-pending application titled DUAL CHAMBER DISPENSING PACKAGE, filed Oct. 30, 1991, and having Ser. No. 07/784,964. In this application, a multiple compartment chamber is disclosed which is normally sealed at one end, such as by a crimp seal, and has a discharge opening at the other end. At least two adjacent compartments are provided for chemical reactants, medicines and the like. Each compartment is aligned at the discharge end and has a thin wall dispensing port for discharge of the contents once the thin wall has been broken.

The device in my co-pending application contemplates the use of bellows means which are formed from the compartments for applying a discharge force to the individual compartments upon squeezing the container. In a preferred embodiment, there are two compartments sharing a common wall which are axially aligned and pivotally joined. These two compartments form a hinge point. Thus, particularly when high viscosity fluids are employed, squeezing the walls of the containers causes the bellows to force fluid out of the discharge ports at a much faster fate than would be achieved by gravity alone.

In most cases when the compartments are made from plastic or other quite flexible materials, designs of the type described above are admirably suited for their intended purposes. Medicines and the like are effectively dispensed and the precise quantity of contents needed is placed at the point where it is most needed. This design is particularly effective in providing precise proportions of two or more ingredients at the point where it is dispensed while at the same time providing a positive force for dispensing the contents. The bellows principle has been found to be particularly helpful, especially with different quantities or viscosities of the two or more fluids in the various containers.

The only drawback to the general field of multiple compartment containers is that sometimes the materials from which the containers are manufactured is too stiff or too inflexible. When small container chambers are needed, for example when eye drops, vitamins, or other small dosage medicines and treating fluids are dispensed, the material from which the containers are formed may prevent ease of sealing. Specifically, when designs such as described in my co-pending application and in my aforementioned U.S. Pat. No. 4,884,703 and others are employed, it is sometimes difficult to seal the end which is used for filling the containers. When bellows like structures are used, particularly on small or stiff compartments, the stress on the end which is to be sealed is potentially too great to permit a complete and effective seal to be achieved.

Another dual compartment container is described in my co-pending application titled DUAL CHAMBER DISPENSING PACKAGE, filed Jan. 31, 1992, and having Ser. No. 07/828,516. In this application, a dual compartment container assembly has been provided which includes two adjacent compartments which are separated by a common wall segment. The container includes a discharge end which is operable to permit dispensing of the contents of said container, and a filling end which is sealed after contents are placed in said compartments. The two adjacent compartments have outer arcuate walls which extent from the common wall segment to form the compartments. The common wall segment has a first width prior to filling and a second longer width after the filling end is sealed to form a seal at the filling end. In a preferred embodiment, the common wall segment is pleated to have a first length prior to filling and a second straightened longer width after the filling end is sealed.

This invention contemplates the use of bellows on the opposed outer ends of both chambers so that effective pressure can be applied to the insides of the chambers to force the full dosage out of the chamber. While this is effective, particularly in designs where the tube material is flexible and where the size of the container is sufficiently large, there is one drawback to this design when the container is small and relatively rigid.

Under some circumstances, the inclusion of the two outer walls, the center or common wall, and the folded overlap from the two bellows like portions of the outer walls results in a configuration where 5 or more thicknesses are being compressed at the filling end. It is sometimes difficult to achieve a complete seal that has integrity and reliability that satisfies even the most strict standards. Additionally, the pleated center wall is formed with its own stresses due to the "memory" of the plastic. These stresses form some kind of resistance to a perfectly reliable seal at this filling end. This can place an undue stress on the heat seal or other closure and cause a problem in expelling all of the contents of the two compartments of the container. More important is the concern that the seal may not keep its integrity for the useful life of the container. There is the possibility that this undue stress may cause the common wall to crack or separate, causing the contents to mix at the wrong end of the container.

Accordingly, it is an object of this invention to provide a simple and effective design for dual compartment containers which permits a safe and complete seal of the filling end of the container.

Another object of this invention is to provide a sealing system for dual compartment containers which are small and relatively inflexible compared to larger containers, and yet which permits all of the contents to be expelled.

Yet another object of this invention is to provide a seal design for use with dual compartment containers which employ pressure dispensing features such as bellows shaped containers and the like in a manner which allows for complete expulsion of the contents while maintaining seal integrity.

Other objects will appear hereinafter.

SUMMARY OF THE INVENTION

It has now been discovered that the above and other objects of present invention may be accomplished in the following manner. Specifically, a dual compartment container assembly has been discovered which includes two adjacent compartments which are separated by a common wall. The container includes an improved filling end which is sealed in an improved manner after contents are placed in said compartments.

The common wall has a first width prior to filling and an longer width forming a straight line seal at a point spaced from the filling end. Preferably the width of the common wall is adjusted in this manner by forming a gentle "s" curve in the wall, rather than sharp corners such as are found in pleats, so that as it is pulled at both ends where it is joined to the outer walls, the pleats will straighten and the width will increase without adding resistance stress from the pleated junctions.

The two outer walls terminate axially at the filling end so that the end can be sealed. The preferred method of sealing the filling end is to place the end in a clamping device which applies pressure, and heat if desired, to force the walls to seal. Since the material from which these containers are fabricated is often a thermoplastic material, heat sealing is relatively easy. Of course, if the material in the compartments is heat sensitive, pressure alone or pressure and an adhesive can be employed.

The present invention also includes a common wall which terminates at the filling end so as to provide a filling end seal region with three commonly bonded wall. This is important to prevent stress on the internal or common wall.

Pressure and heat if needed is used to form the seal at the filling end by joining the ends of the outer walls. The seal extends axially inward to include the end of the common wall in only a portion of the seal. In this manner, the two compartments are separated and the contents do not mix, but the alignment of the compartments and the common wall which has been stressed to make the seal still permits the contents to be expelled easily and without undue effort.

The outer walls are joined with the common wall to form axially aligned pivotal junctions to define bellows. The bellows themselves terminate before the region where the seal is to be formed, so that none of the bellows thickness is imparted to the seal region. It is preferred that the straight line seal is a heat seal.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
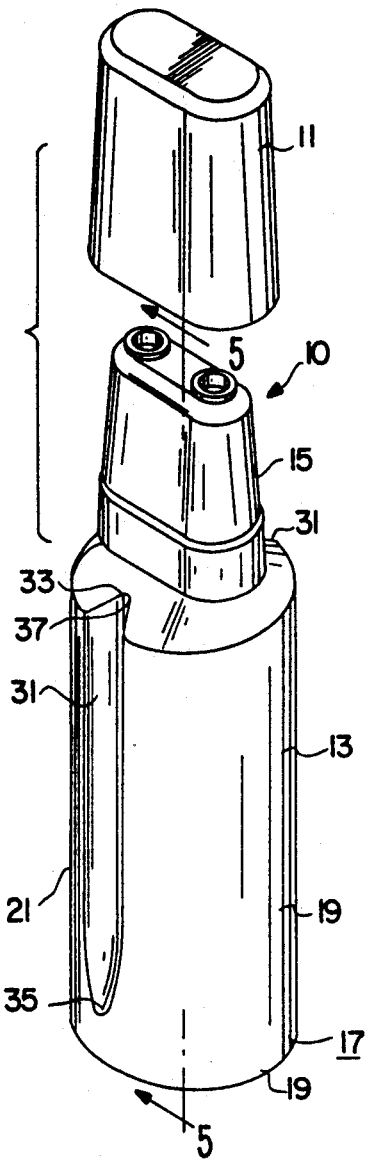
FIG. 1 is an exploded, isometric view of an unsealed, dual compartment, pierce point, bellows tube, with the dual pierce point member shown separated from the tube.

As is shown in the drawings, the assembly of this invention is shown generally by the reference number 10. The container assembly includes a cap 11 which fits on tube 13 at the discharge end 15 as described in my previously identified U.S. Pat. No. 4,884,703 and my co-pending application titled DUAL CHAMBER DISPENSING PACKAGE, filed Oct. 30, 1991, and having Ser. No. 07/784,964. Both the patent and the application show dual compartment container assemblies which are suitable for use with the present invention.

Figure 2:
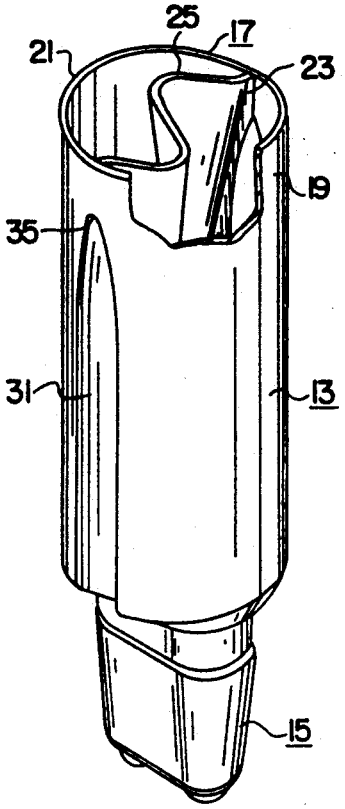
FIG. 2 is an isometric view of the unsealed dual compartment bellows tube shown in FIG. 1 in an inverted position, with a portion broken away.
Figure 3:
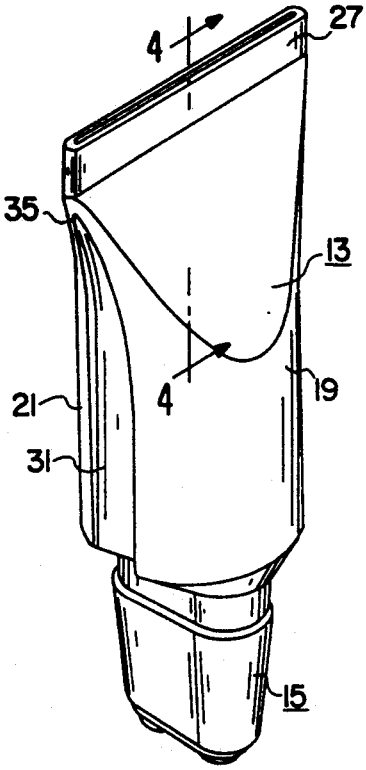
FIG. 3 is an isometric view similar to FIG. 2, but showing the dual compartment bellows tube in a sealed configuration.

The filling end 17 of tube 13 is provided with the improved seal of the present invention as is described herein. As shown in FIG. 2, the filling end 17 is formed by the terminal ends of arcuate walls 19 and 21, which are joined to each other and to a common wall 23. Common wall 23 has a first width before filling which is shorter than the width after filling. Common wall 23 is shown with a gentle "s" curve 25, which allow the width to expand when the end 17 is sealed with a seal 27, usually by pressure and heat without. Seal end 27 is a straight line seal, in that all of the walls 19, 21 and 23 form a straight line which is perpendicular to the axis of the container 13. The thickness is three layers thick, which can easily be accommodated by conventional sealing devices.

Figure 4:
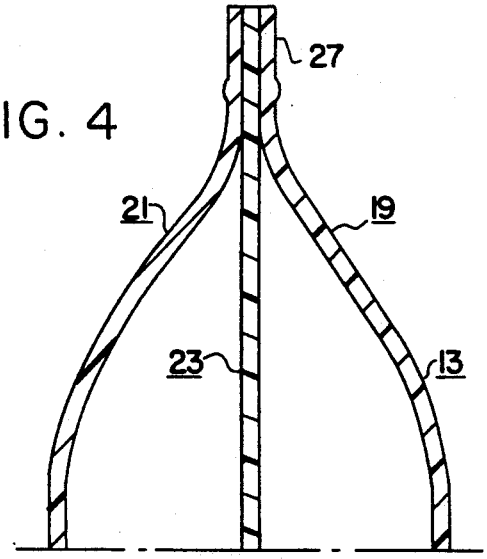
FIG. 4 is a greatly enlarged, fragmentary sectional view taken on the line 4,4 of FIG. 3, showing the heat sealed junction of the tube side walls and the entrapped flattened and extended medial strip.

FIG. 4 shows the seal region 27 after sealing pressure has been applied. It is important that the terminal ends of walls 19, 21 and 23 form the relationship shown in FIG. 4, which relationship includes the seal region 27 and an additional region of seal 29. The terminal ends of arcuate walls 19 and 21 are sealed at their end against each other to form a straight line seal and to insure that the seal is effective to preserve the integrity of the contents. Those terminal ends of arcuate walls 19 and 21 are also sealed to the terminal end of common wall 23 to seal and separate the contents of the two compartments and to present a geometric alignment of the walls 19, 21 and 23 which allows for most efficient expulsion of the contents at the time they are to be used. By including the straight portion of the common wall 23 in the seal region 27, distortion is eliminated and the end, particularly in small scale versions, will no longer twist.

It has been discovered that it is important to eliminate a four layer seal, which is otherwise formed from walls 19 and 21 and from wall 23 when pleats in walls 19 and 21 are folded on to each other. A wall thickness of only walls 19, 21 and 23 provides a much superior seal.

The arcuate walls 19 and 21 form a pair of bellows 31 as the walls 19 and 21 are fixedly joined to common wall 23 at both ends of the arcuate walls 19 and 21. The portion of the wall junctions which forms bellows 31 extends axially from the cap end of tube 13 to a terminating point 33 at the beginning of seal region 27. Bellows 31 also pivot about pivot point 37, which is the junction point between walls 19 or 21 and in this manner, the bellows 31 may be collapsed completely to totally expel the contents from tube 13. If terminating point 33 extends into the seal region 27, it will be impossible to expel viscous liquids and gels which need to be pressed out. The above mentioned five layer seal will not have reliability and integrity that is expected. This particular advantage of the present invention is important when the contents are expensive, or when a single unit dose is contained therein and the entire dose is needed for treatment or application.

Figure 5:
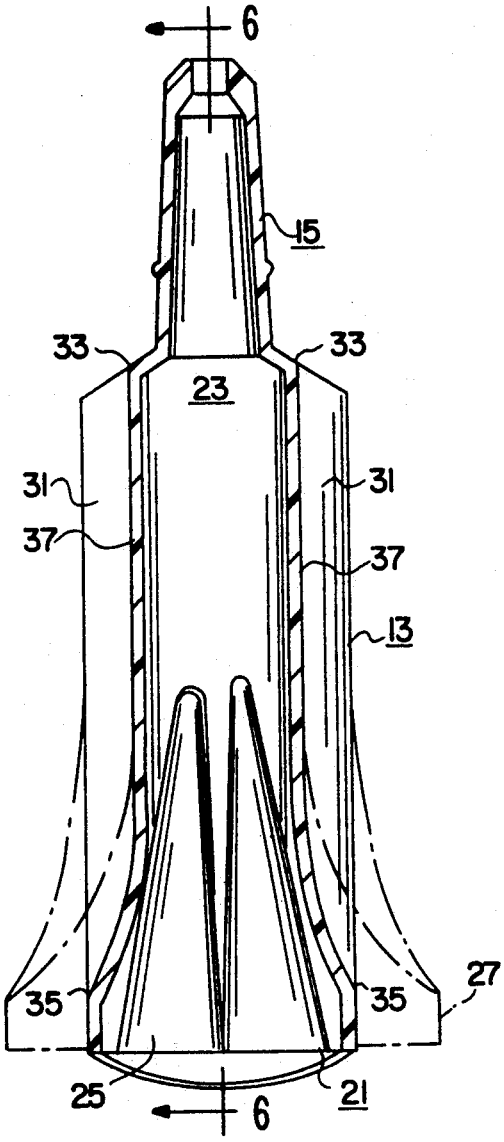
FIG. 5 is an enlarged, sectional, elevational view of the dual compartment bellows tube shown in FIG. 1 and taken along the line 5,5 of FIG. 1, shown with the tube in an unsealed condition with the dot and dash lines profiling the tube in a sealed configuration.
Figure 6:
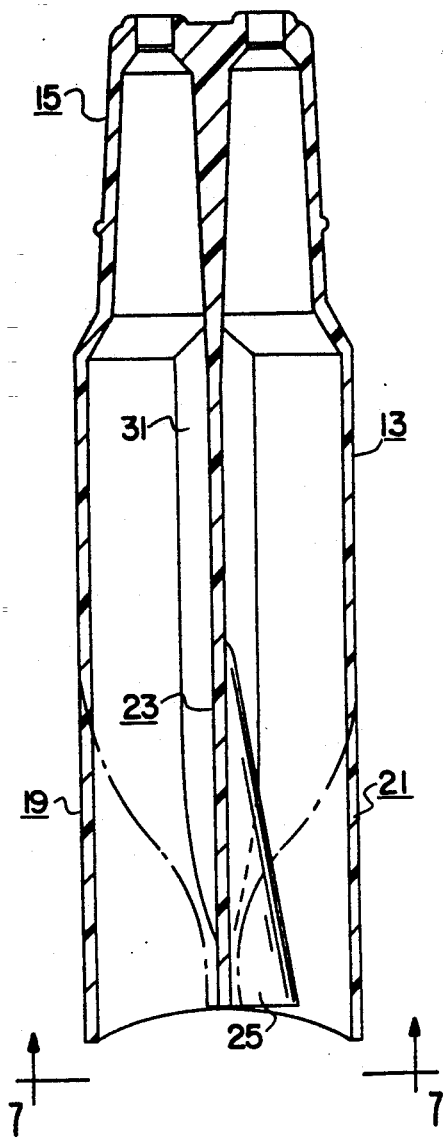
FIG. 6 is a sectional elevational view taken on the line 6,6 of FIG. 5.

It is an important feature of the present invention to preserves the regular expectations of users of single compartment tubes while also giving a superior seal. When the tube is used, the tapered sides of the two walls 19 and 21 form bellows 31, in which the bellows pivot about pivotal junctions 37, as shown in FIGS. 1 and 5, and allow squeezing pressure to force all of the contents out the discharge ports.

Figure 7:
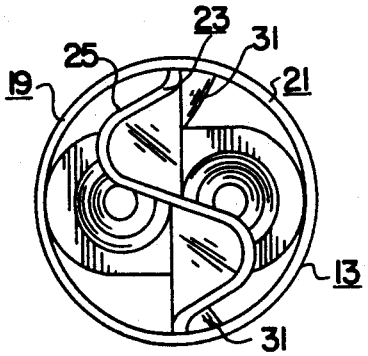
FIG. 7 is a bottom plan view of FIG. 6, taken along the line 7,7 of FIG. 6.
Figure 8:
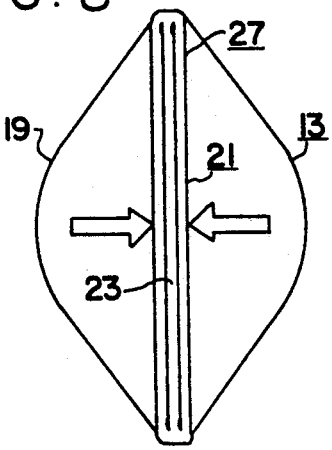
FIG. 8 is a view similar to FIG. 7 and showing the terminal ends of the outer arcuate side walls pressed inwardly to form double thickness linear seal.

FIGS. 7 and 8 show the effect of pressure (and heat if needed) to form the seal as pleats 25 are straightened and the lower terminal ends of arcuate walls 19, 21 and 23 are brought together to form a safe and sanitary closure once the contents have been added to the two compartments. As shown in FIG. 4, there is a sufficient length at the terminal end of common wall 23 to insure that leakage between the two chambers is also prevented.

While particular embodiments of the present invention have been illustrated and described, it is not intended to limit the invention, except as defined by the following claims.

I claim:

1. A dual compartment container assembly, comprising:

a container having two adjacent compartments defined by a common wall segment and a pair of outer arcuate walls, said container having a filling end which is sealed after contents are placed in said compartments;

said common wall segment having a first width prior to filling and a second longer width after said filling end is sealed to form a straight line seal at a point spaced from said filling end;

said outer arcuate walls and said common wall segment terminating axially at said filling end to provide a filling end seal region such that pressure forming a seal at said filling end joins the terminal ends of said outer arcuate walls to form a straight line seal including the terminal end of said common wall segment in said filling end seal region; and said outer arcuate walls extending arcuately from junctions with said common wall segment to form bellows between said compartments, said bellows terminating at a point axially spaced from said seal region such that none of the bellows is included in the straight line seal.

2. The assembly of claim 1, wherein said arcuate walls are joined at each junction with said common wall segment to form axially aligned pivotal junctions.

3. The assembly of claim 2, wherein said arcuate walls and said common wall segment form said bellows by said compartments tapering outwardly from the axially inward most point of said straight line seal.

4. The assembly of claim 1, wherein said straight line seal is a heat seal.

5. The assembly of claim 1, wherein said common wall segment is curved to have a first width prior to filling and a second straightened longer width after said filling end is sealed to form a straight line seal at said filling end.

6. The assembly of claim 1, wherein said common wall has an "s" shaped curve in said first width.

7. A dual compartment container assembly, comprising:

a container having two adjacent compartments defined by a common wall segment and a pair of outer arcuate walls, said container having a filling end which is sealed after contents are placed in said compartments;

said common wall segment being curved to have a first width prior to filling and a second straightened longer width after said filling end is sealed to form a straight line seal at said filling end;

said outer arcuate walls and said common wall segment terminating axially at said filling end to provide a filling end seal region such that pressure forming a seal at said filling end joins the terminal ends of said outer arcuate walls to form a straight line seal and said filling end seal region includes the terminal end of said common wall segment in said filling end seal region; and said outer arcuate walls extend arcuately from junctions with said common wall segment to form bellows between said compartments, said arcuate walls being joined at each junction with said common wall segment to form axially aligned pivotal junctions to define said bellows by causing said compartments to taper outwardly from a point axially inward from said straight line seal, said bellows terminating at a point axially spaced from said seal region such that none of the bellows in included in the straight line seal.

8. The assembly of claim 7, wherein said straight line seal is a heat seal.

9. The assembly of claim 7, wherein said common wall has an "s" shaped curve in said first width.

* * * * *